United States Patent [19]

Mueller

[11] Patent Number: 4,733,053

[45] Date of Patent: Mar. 22, 1988

[54] GLOW ELEMENT

[75] Inventor: Helmut Mueller, Maulbronner, Fed. Rep. of Germany

[73] Assignee: Beru Ruprecht GmbH & Co. KG, Ludwigsburg, Fed. Rep. of Germany

[21] Appl. No.: 822,875

[22] Filed: Jan. 27, 1986

[30] Foreign Application Priority Data

Jan. 25, 1985 [DE] Fed. Rep. of Germany ..... 3502525

[51] Int. Cl.[4] ..... H05B 1/02; H05B 3/00; F23Q 7/00; F02P 19/02

[52] U.S. Cl. ..... 219/270; 123/145 A; 219/267; 219/523; 219/553; 338/22 R; 338/239; 361/266

[58] Field of Search ..... 219/260, 262, 267, 270, 219/523, 544, 552, 553, 541; 338/238–242, 22 R; 123/145 R, 145 A; 361/264–266

[56] References Cited

U.S. PATENT DOCUMENTS

| | | | |
|---|---|---|---|
| 1,590,892 | 6/1926 | Heany | 123/145 A |
| 1,948,974 | 2/1934 | Talmy | 123/145 A |
| 2,492,755 | 12/1949 | McCollum | 123/145 A |
| 2,840,067 | 6/1958 | Carlson | 123/145 A |
| 3,689,195 | 9/1972 | Beesch et al. | 123/145 A |
| 4,351,291 | 9/1982 | Mahaney | 123/145 A |
| 4,423,309 | 12/1983 | Murphy et al. | 123/145 A |
| 4,549,071 | 10/1985 | Hatanaka et al. | 219/270 |

FOREIGN PATENT DOCUMENTS

| | | | |
|---|---|---|---|
| 98503 | 6/1983 | European Pat. Off. . | |
| 2802625 | 7/1970 | Fed. Rep. of Germany . | |
| 2937884 | 4/1981 | Fed. Rep. of Germany | 123/145 A |
| 3334038 | 4/1985 | Fed. Rep. of Germany | 219/270 |
| 204727 | 12/1982 | Japan | 219/262 |
| 210412 | 12/1983 | Japan | 219/270 |

*Primary Examiner*—Anthony Bartis

*Attorney, Agent, or Firm*—Sixbey, Friedman & Leedom

[57] ABSTRACT

In a glow element with a glow tube (30) closed at the outer end, in which there at least two series-connected resistors (10, 11), whereby one of the at least two resistors being conductively connected by one end to the closed end of the glow tube and the opposite end of the series-connected resistors being connected to an internal pole (9) projecting into the glow tube from the other end thereof, in order to permit an external wiring of part of the resistors in the glow element, the internal pole (9) has a tubular construction and at least one electrical conductor (8) is passed through the internal pole and is connected to a junction (12) of the at least two resistors (10, 11). Furthermore, the at least two resistors comprise a heating resistor (11) electrically connected to the closed end (14) of the glow tube (30) and a variable resistor (10) with a positive temperature coefficient electrically connected between the internal pole (9) and the heating resistor (11), and wherein a further variable resistor (R3) with a positive temperature coefficient is arranged externally of the glow element and is electrically connected to the electric conductor (8) parallel to the variable resistor (10) of the series-connected resistors.

6 Claims, 19 Drawing Figures

GLOW ELEMENT

The present invention relates to a glow element with a glow tube that is closed at an outer end and in which at least two series-connected resistors are located.

Such a glow element in the form of a glow plug is known from DE-OS No. 28 02 625. In this known glow plug, the resistor connected to the closed end of the glow tube is heating resistor, whilst the second resistor has a marked positive temperature coefficient and regulates the heating up of the heating resistor.

It is also known to merely provide the heating resistor in a glow plug and for external electrical wiring to be responsible for its temperature or heating up behaviour (DE-OS No. 32 24 587).

Such external wiring is often complicated and costly, whilstin the case of a self-regulating glow plug with a heating and regulating coil in the glow pin, it is not possible to achieve very short heating up times, as required for the immediate starting of diesel engines, without prejudicing the spark plug.

With the present invention, a glow plug with its own heating and regulating coil can additionally be externally wired in such a way that, after a very short heating up time, after glowing is possible at a low heating rod temperature, so that the true running of a still cold diesel engine is improved and the amount of exhaust is reduced. The glow element according to the invention also makes it possible to take measured values directly from a partial resistor, which can then be supplied to a regulating means for evaluation purposes. Moreover, self regulation is possible through simple external wiring.

Figure 1:
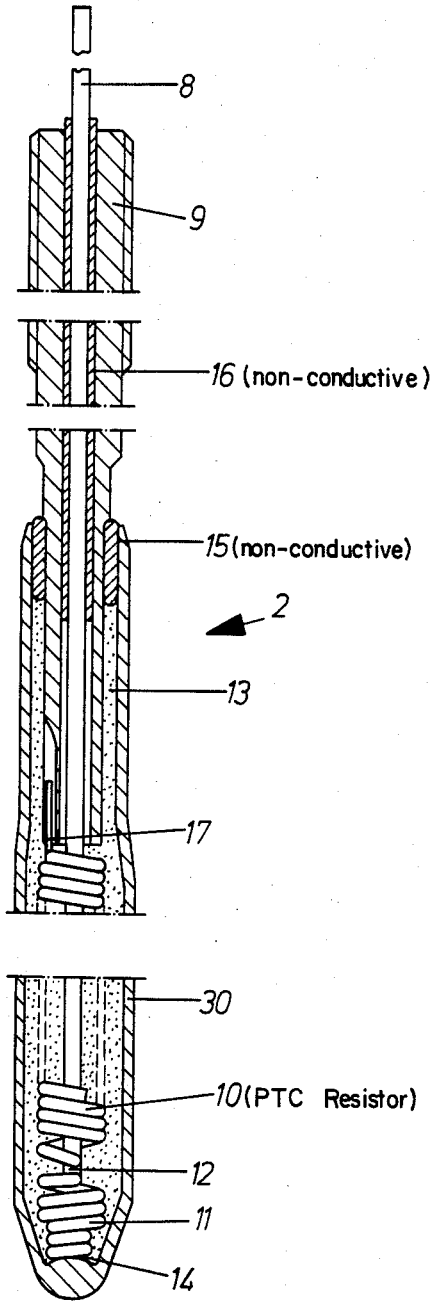

Embodiments of the invention are described hereinafter relative to the drawings, wherein show:

FIG. 1. a glow element according to an embodiment of the invention.

Figure 2:
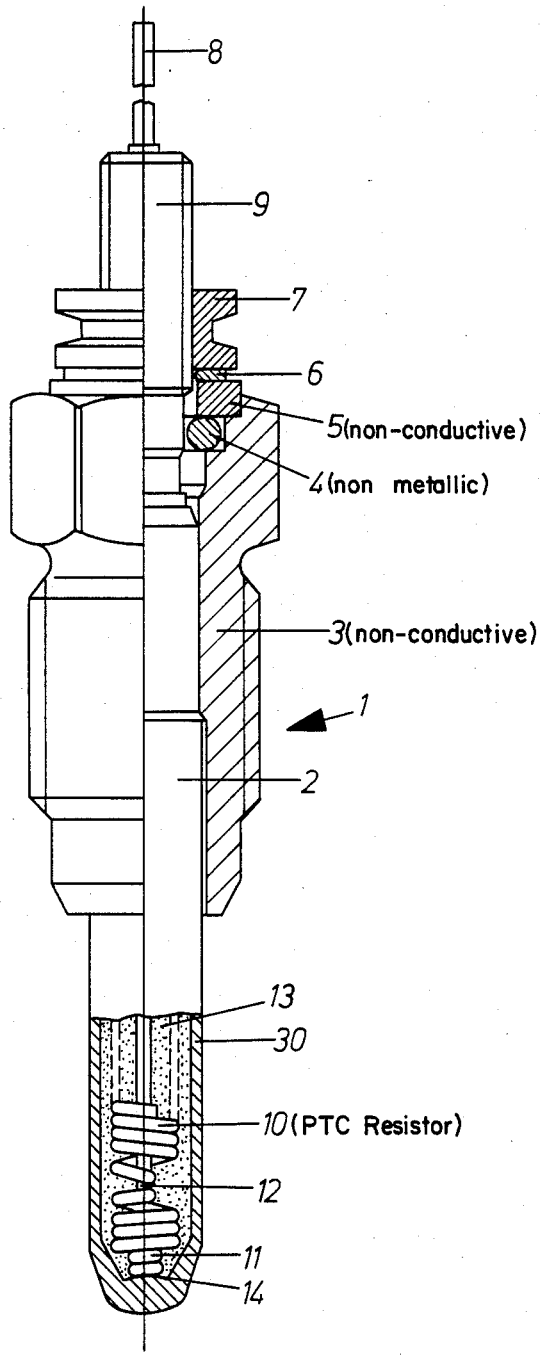

FIG. 2. a glow plug with the glow element shown in FIG. 1.

Figure 3:
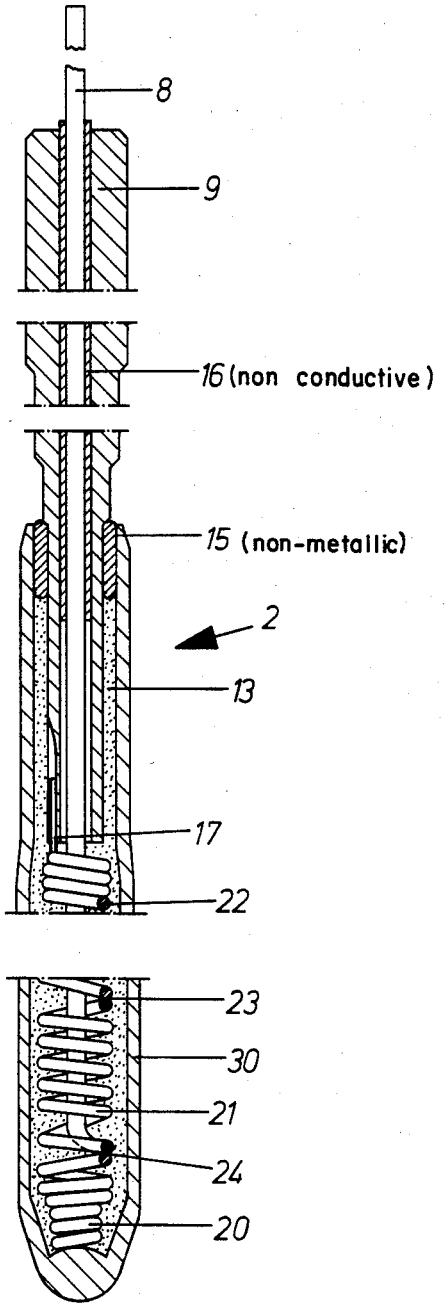

FIG. 3. a glow element according to another embodiment of the invention.

Figure 4:
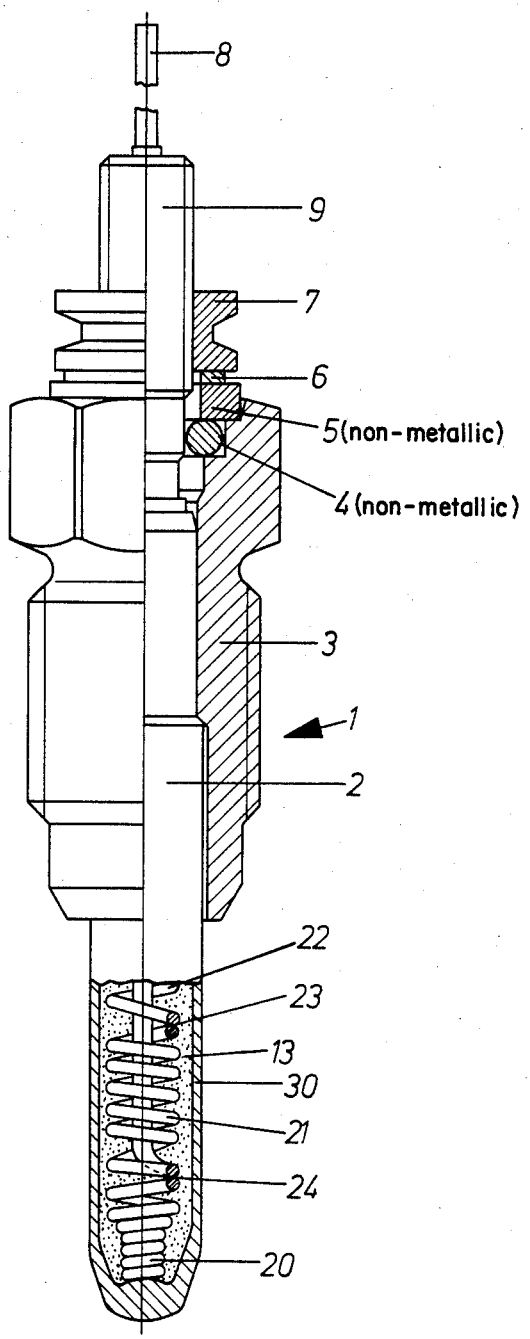

FIG. 4. a glow plug with the glow element shown in FIG. 3.

Figure 5:
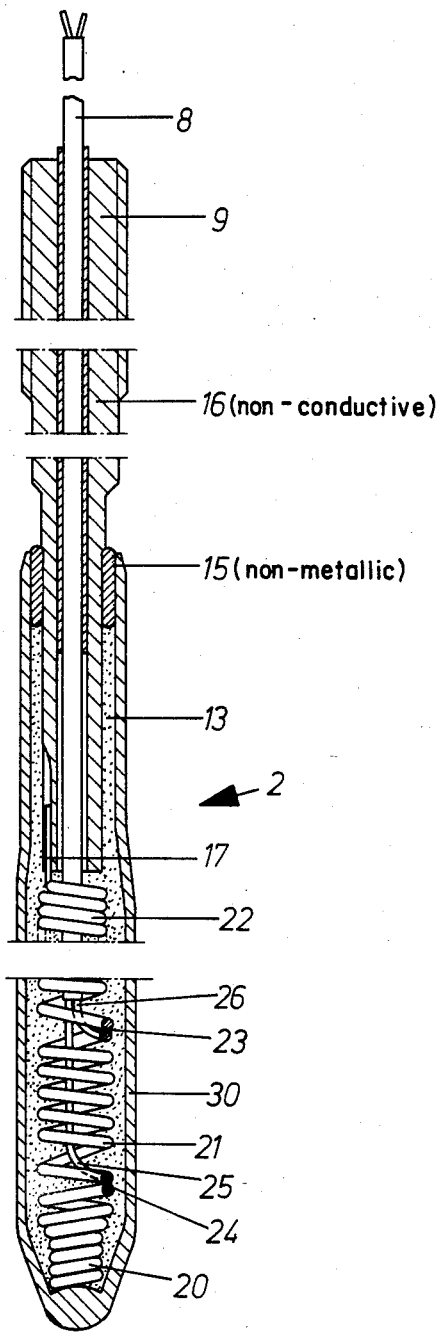

FIG. 5. a glow element according to another embodiment of the invention.

Figure 6:
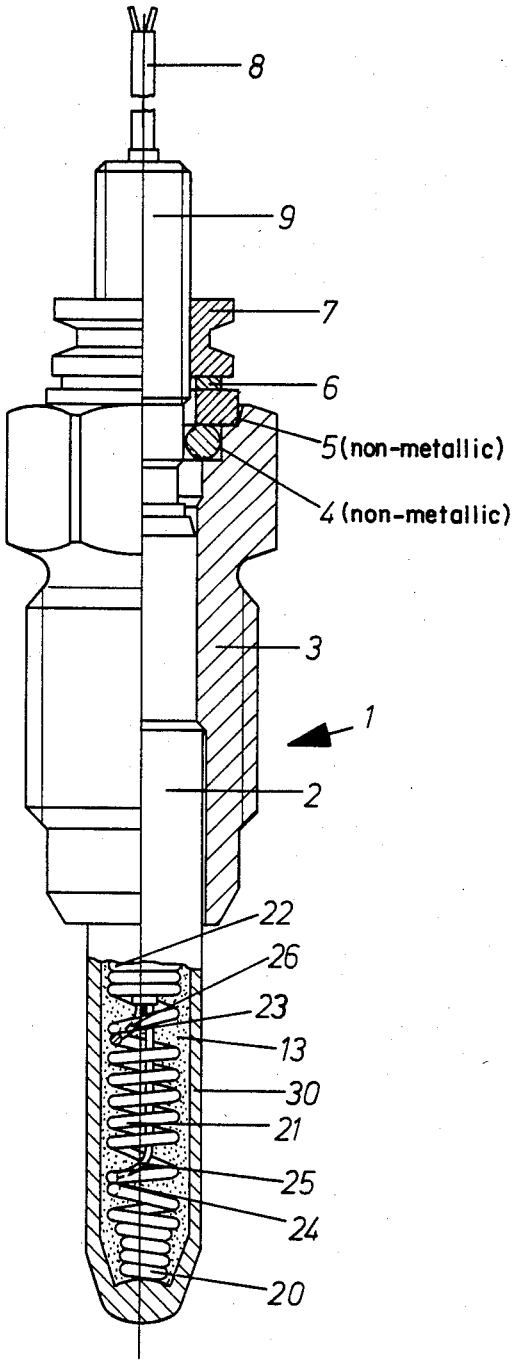

FIG. 6. a glow plug with the glow element shown in FIG. 5.

Figure 7:
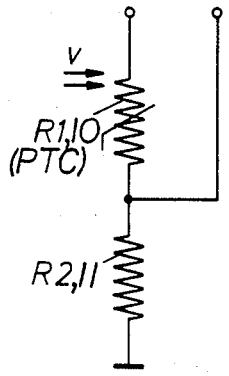

FIG. 7. the circuit diagram of the glow element shown in FIG. 1.

FIGS. 8 to 13. examples of external wiring of the glow element shown in FIG. 1.

Figure 14:
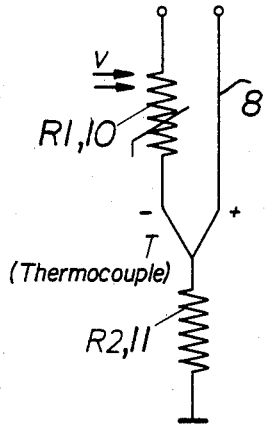

FIG. 14. the circuit diagram of a glow element according to FIG. 1 or a glow plug according to FIG. 2 in a construction as a temperature measurement glow element or glow plug.

Figure 15:
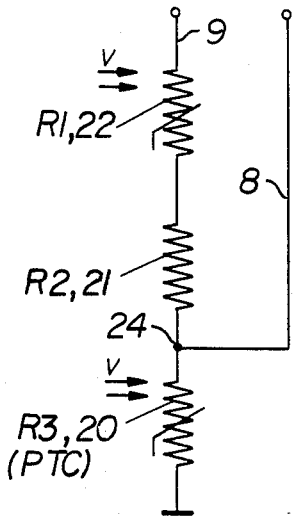

FIG. 15. the circuit diagram of the glow element shown in FIG. 3.

Figure 16:
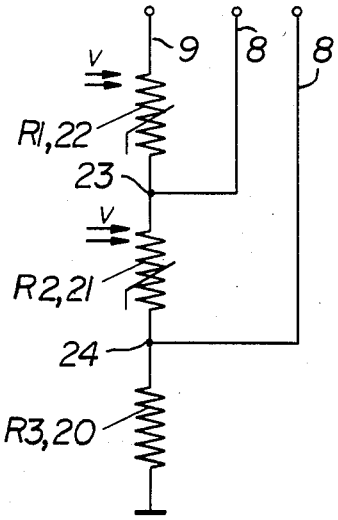

FIG. 16. the circuit diagram of the glow element shown in FIG. 5.

Figure 17:
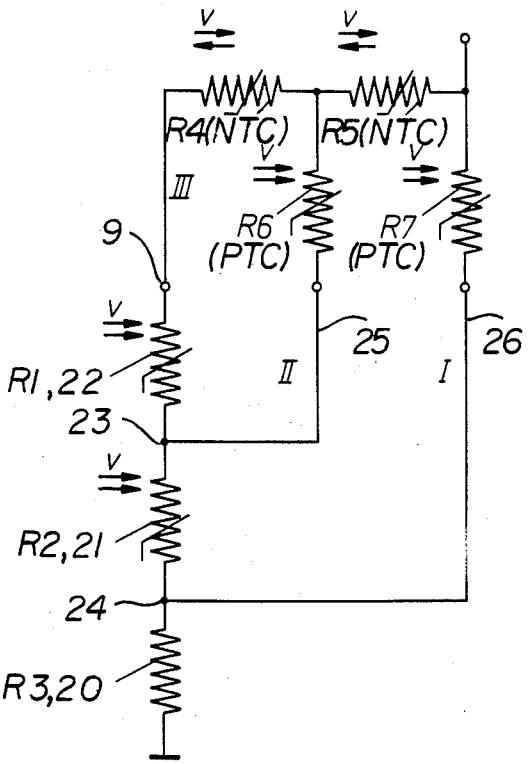

FIG. 17. an example of the external wiring of the glow plug shown in FIGS. 5 or 6.

Figure 18:
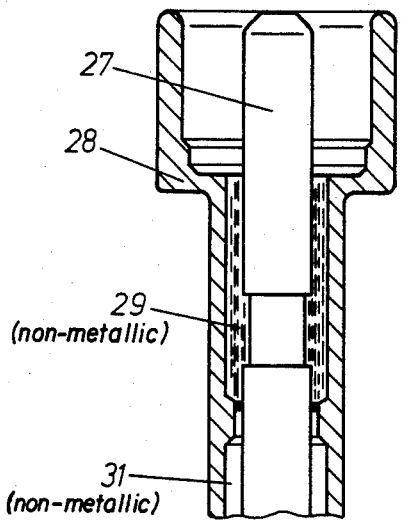

FIG. 18. an embodiment for a coaxial connecting element for e.g. the glow plug of FIG. 1.

Figure 19:
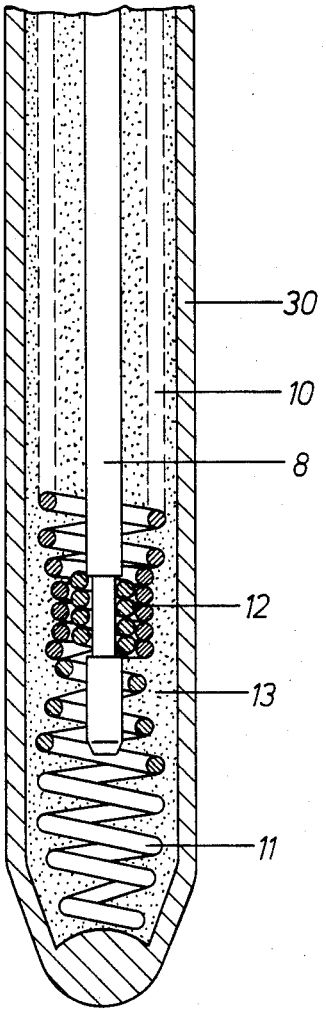

FIG. 19. a special embodiment of the connection of the conductor to the common point of two resistors.

FIG. 2 shows a glow plug 1, whose heating or glow element 2 is in accordance with FIG. 1. Glow element 2 is provided in known manner with a seal 4, insulating washer 5, thrust washer 6 and round nut 7 mounted in the body 3 of glow plug 1. Glow element 2 contains two series-connected electrical resistors 10, 11 in the form of wire coils. The resistors are embedded in known manner in an insulating material 13 and surrounded by a metal glow tube 30, which is coaxial to body 3 and projects therefrom, being closed at its outer end. At the tip 14 of the glow tube, one of the resistors 11 is electrically conductively connected to glow tube 30. At the other end of the glow tube, the internal pole 9 is electrically insulated and sealingly inserted in glow tube 30, being connected in an electrically conductive manner at 17 to the other resistor 10. A gasket 15 is preferably inserted between the glow tube and the internal pole for sealing and insulation purposes. One of the two resistors 10, 11 has a positive temperature coefficient (PTC) and consequently acts as a regulating resistor. In the presently conventional uses as flow plugs in internal combustion engines, the resistor 11 connected to the closed tip 14 of glow tube 30 is designed as a heating resistor and resistor 10 connected in tip-remote manner to the internal pole is designed as a regulating resistor.

Internal pole 9 is constructed as a hollow cylinder, an electrical conductor 8 being passed through it. The passage of conductor 8 through internal pole 9 must have an electrically insulating construction. This insulation can preferably be an insulating oxide or an insulating hose 16, which simultaneously seals the passage against the penetration of moisture or some other electrically insulating coating. Conductor 8 is passed centrally through resistor 10 located closer to body 3 up to the junction of resistors 10, 11, where conductor 8 is electrically conductively connected to said junction.

The resulting circuit diagram of glow element 2 is shown in FIG. 7, where resistor 10 is shown as a regulating resistor R1 and the other resistor 11 as R2. In order to avoid a significant voltage drop at conductor 8 passed through the internal pole 9 and consequently the production of heat at insulation 16, conductor 8 has a very low resistance compared with resistors 10 and 11.

The described construction of glow element 2 permits a random external wiring of the individual resistors of the glow element. Due to the possibility of the individual wiring of the resistors contained in the heating element, there is an overall simplification of the external wiring with respect to the particular sought objective. Certain examples of simple circuitry or wiring types are shown if FIGS. 8 to 13.

Figure 8:
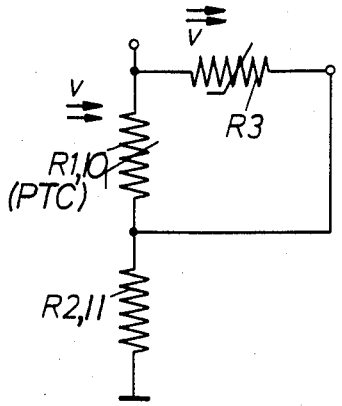

According to FIG. 8, a further resistor R3 with a positive temperature coefficient is arranged parallel to variable resistor R1 outside the glow element. This arrangement of a parallel PTC resistor R3 outside glow plug 1 or glow element 2 leads to a more definite regulating down of the current flowing through heating resistor R2 (11) and consequently to a shortening of the heating up time.

Following switching on, the overall resistor formed by variable resistor R1 (10) and the parallel PTC resistor R3 is kept at a low level, despite the heating of variable resistor R1. As a result of self-heating, the PTC resistor R3 outside the glow plug finally reaches its operating temperature and its resistance value rises to a multiple of the variable resistor R1, so that with regards to further downward regulation, only the variable resistor R1 (10) is involved.

In a further construction, the PTC resistor R3 located outside the glow plug could be placed as a heat sensor in the cooling water, engine oil, exhaust or cylinder head and can perform a temperature measurement function following the glowing process.

Figure 9:
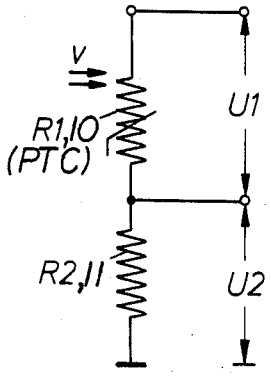

FIG. 9 shows the possibility of a temperature measurement via the voltage drop at heating resistor R2 (11) or variable resistor R1 (10). The voltage drop U1 or U2 at variable resistor R1 or heating resistor R2 is a measure of the temperature of the glow tube. This quantity can be used for glow monitoring, as an indication or display, or as a manipulated variable in a control loop.

Figure 10:
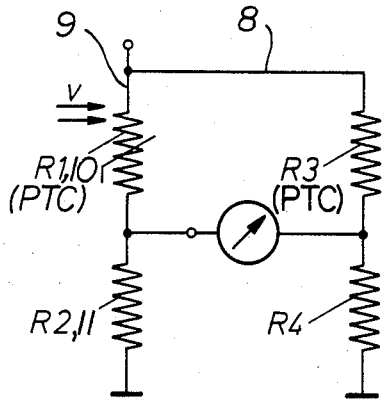

Conductor 8 connected between heating resistor 11 and variable resistor 10 and passed out through the internal pole 9, after providing a resistor R3 parallel to variable resistor R1 (10) and a resistor R4 parallel to heating resistor R2 (11), makes it possible to form all possible bridge circuits, such as the bridge shown in fig 10. The external wiring of the bridge is such that it is balanced at the desired glow temperature. The reversal of the current direction in the bridge then corresponds to the signal for reaching the desired glow tube temperature.

Through wiring conductor 8 of glow element 2 with a mechanical or electronic switching element, at two-stage or multistage connection of individual resistors is possible.

Figure 11:
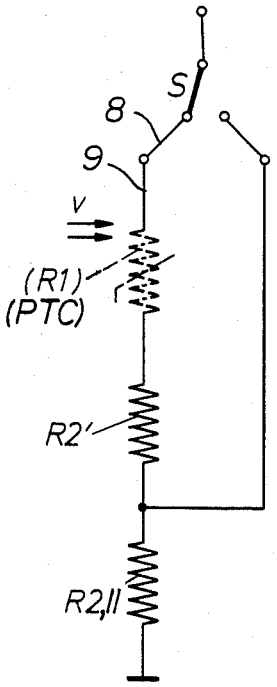

According to FIG. 11 only heating resistor R2 (11) can initially be controlled by a switch S constructed as a reversing switch. If then, e.g. at the tip of glow tube 30, the desired temperature is reached, then one or more heating resistors R2′ are connected in stepwise and then heat the complete glow tube up to the operating temperature. Switch S can be operated mechanically, thermally (e.g. as a bimetal switch) or electrically (e.g. time-controlled). In addition to the heating resistors R2 and R2′, a variable resistor R1 can be connected upstream thereof. In addition, one of the heating resistors can be replaced by a variable resistor.

Figure 12:
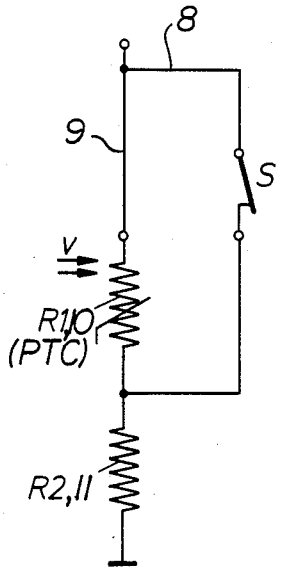

According to the further embodiment shown in FIG. 12, instead of being the reversing switch of FIG. 11, the switching element can be a simple cutout in the parallel branch to variable resistor R1 (10) built up with the aid of conductor 8.

Figure 13:
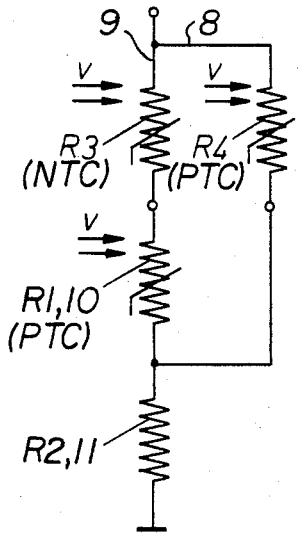

FIG. 13 shows an example for the stepwise connection of heating resistors R2, R1 by a temperature-dependent resistor R3 with a negative temperature coefficient and a temperature-dependent resistor R4 with a positive temperature coefficient. In the case of the circuit shown in FIG. 13, after switching on (PTC resistor R4 and NTC resistor R3 still cold), the PTC resistor 4 has a low resistance value and NTC resistor R3 a high resistance value, which means that initially only heating resistor R2 acts in the glow tube tip until the latter has heated to the desired temperature. Through self-heating, the PTC resistor R4 becomes high value and the NTC resistor R3 low value, which means that the second heating resistor R1 acts continuously. As a result the glow tube tip is rapidly heated and without additional wiring connects in the heating of the complete glow tube. For further regulating down the heating power, the second heating resistor R1 can be in the form of a variable resistor with a positive temperature coefficient. PTC resistor R4 and NTC resistor R3 can again be placed in the cooling water, engine oil, exhaust or cylinder head as heat sensors.

According to the circuit shown in FIG. 14, the conductor 8 passed through the internal pole 9 forms one pole of a thermocouple T, which is obtained at a weld 12, if e.g. the variable resistor R1 (10) is made from Ni and the conductor 8 from NiCr. By means of external wiring it is possible to switch from "heating" to "temperature measurement". In this way, e.g. following the heating process, the glow rod temperature can be monitored and the heating energy connected in again when there is a corresponding temperature drop. The heating pattern can be monitored by corresponding timing processes during the heating process and in this way the filament or heating energy can be regulated from the outside.

FIG. 4 shows another embodiment of a glow plug 1A, in which the glow element 2A shown in FIG. 3 contains a series-connection of three individual resistors 20, 21 and 22. Conductor 8 passed through the internal pole 9 taps an individual resistor (e.g. resistor 20 located in the glow tube tip) at 23 or 24. The three individual resistors are preferably designed in such a way that at least one of these has a positive temperature coefficient and can therefore fulfill regulating or measuring functions.

Otherwise the construction of the glow element shown in FIG. 3 or the glow plug shown in FIG. 4 do not differ from those of FIGS. 1 or 2.

FIG. 15 shows a circuit example, in which there is a variable resistor R3, tapped by a conductor 8, in the glow tube tip. This is a glow element, in which the glow tube requires a hot shaft, so that the variable resistor can be located in the glow tube tip. In this arrangement, the additional conductor 8 can be used for monitoring or measuring the resistance value of the variable resistor R3 (20) in the glow tube tip and consequently the temperature of the latter. If resistor R3 is in the form of a resistor with a positive temperature coefficient, this supports the self-regulation of the heating energy. If energy is supplied from the outside to the glow tube tip (e.g. flame energy), then resistor R3 automatically regulates down the heating energy and if the external energy fails, then more electrical energy is supplied again. As a result of a corresponding design, a further variable resistor R1 can be completely replaced by a resistor R3.

FIG. 6 shows a glow plug 1B with a glow element 2B constructed according to FIG. 6, in which a two-wire conductor 8 or two conductors 25, 26 are passed through the internal pole 9. The resistors in glow tube 30 are formed by three series-connected resistors 20, 21, 22, as in FIGS. 3 and 4. Conductor 25 is connected to the junction 24 of resistors 20, 21 and the second conductor 26 to the junction 23 of resistors 21, 22, so that each of the three individual resistors can be individually wired outside the glow element or spark plug. It is consequently e.g. possible to connect stepwise three heating resistors, to measure the temperature by tapping a temperature-dependent resistor or effect other switching operations.

FIG. 16 shows a circuit diagram for such an embodiment of glow element 2, in which resistors R1 (22) and R2 (21) act as variable resistors and R3 (20) acts as a heating resistor.

FIG. 17 shows a possibility for the wiring of the glow element according to FIG. 5 or the glow plug of FIG. 6, in which the variable resistors R1 and R2 act continuously. For this purpose, two resistors R4 and R5 with negative temperature coefficients are connected in series with the resistors of glow element 2 outside the same. Parallel resistors R6, R7 connected outside heating element 2 via conductors 25, 26 have a positive temperature coefficient. In the case of a multicylinder engine, i.e. several spark plugs, the resistors present outside the glow plugs only exist once.

By corresponding design of resistors R4 to R7, the variable resistors R1, R2 operate continuously in addition to R3, which leads to a rapid heating up of the heating rod.

Resistor R2 e.g. regulates the temperature of glow tube 30 to the desired value for the starting process. For the subsequent after glow, the glow tube temperature is further reduced via R1. Hereagain resistors R4 to R7 can be placed in the cooling water, engine oil, exhaust or cylinder head as heat sensors and can assume the temperature measurement function following the glowing process.

For use in a diesel engine, it is e.g. possible to use the following construction. R4 and R6 are thermally conductively interconnected, but are also well thermally conductively coupled with respect to the cooling water, engine block or engine oil (e.g. housed in a heat sensor casing). R5 and R7 are thermally more closely coupled together than with the engine temperature, so that the self heating of R7 is rapidly transferred to R5, but both are only heated in a delayed manner by the engine heat (e.g. together on a circuit board in the vicinity of the engine).

In the case of a cold start the highest current flows via branch I until R7 has reached its operating temperature due to self heating. As a result branch I has a very low current. R7 has now heated R5 to such an extent that the latter has become low value and in branch II flows a current decreasing with the temperature of R2 (equals glow plug temperature) and the temperature of R6 (e.g. cooling water temperature). Branch III becomes current-carrying if R4 is heated (e.g. cooling water hot) and the glow plug is not yet at operating temperature or has already cooled again through increased fuel supply (opening the throttle in the case of engine loading)

In the case of a hot start, the current flow in branch I is blocked, because R7 is hot. Branch II is also blocked, because R6 is also hot. A decreasing current flows in branch III, as a result of the behavior of R1 and R2.

The connection of internal pole 9 and conductor 8 of heating element 2 is not shown in greater detail in FIGS. 1 and 2, or 3 and 4. As shown in FIG. 18, this can be in the form of a coaxial plug connection, whereof the internal conductor 27 is connected to conductor 8 and whereof the external conductor 28 is connected to the internal pole 9. An electrically insulating coating, e.g. sealed-in glass 29 is provided between internal conductor 27 and external conductor 28. The coaxial plug according to FIG. 24 can also be shaped in one piece on internal pole 9 and conductor 8. An insulating hose 31 surrounds conductor 8.

FIG. 19 shows another embodiment of the connection of conductor 8 to resistors 10 and 11. Initially the start of the coil of resistor 11 is wound onto conductor 8 and then the end of the coil of resistor 10 is wound on. As a result of a reduction process, in which the insulating material 13 is compressed, resistors 10 and 11 are firmly connected to conductor 8.

I claim:

1. Glow element system having a glow element with a metallic glow tube (30) closed at an outer end in which are arranged at least two series-connected resistors (10, 11, 20, 21, 22), one of the at least two resistors being conductively electrically connected by one end to the closed end of the glow tube and the opposite end of the series-connected resistors being electrically connected to an internal pole (9) that projects into the glow tube from the other end thereof, characterized in that the internal pole (9) has a tubular construction, that at least one electrical conductor (8) is passed through the internal pole in electrically insulated relation thereto and is electrically connected to a junction (12, 23, 24) of the at least two resistors (10, 11, 20, 21, 22) and that the at least two resistors comprise a heating resistor (11) electrically connected to the closed end (14) of the glow tube (30) and a variable resistor (10) with a positive temperature coefficient electrically connected between the internal pole (9) and the heating resistor (11), and wherein a further variable resistor (R3) with a positive temperature coefficient is arranged externally of the glow element and is electrically connected to the electric conductor (8) parallel to the variable resistor (10) of the series-connected resistors.

2. Glow element system according to claim 1, characterized in that the at least one conductor (8) is coated with an electrically oxide.

3. Glow element system according to claim 1, characterized in that the electrical connection of the at least one conductor (8) at the junction (12) is formed by the start of a winding of a coil forming one of the series-connected resistors (11) being wound onto the at least one conductor (8) and an end of a winding of a coil forming the other of the series-connected resistors being wound thereover (10), the start of the winding and the winding end would thereon being pressed against the conductor by an insulating material (13) in the glow tube (30) being compressed (FIG. 19).

4. Glow element system according to claim 1, wherein the glow element is formed as part of a glow plug.

5. Glow element according to claim 2, wherein the glow element system is formed as part of a glow plug.

6. Glow element system according to claim 5, wherein the glow element is formed as part of a glow plug.

* * * * *